US008787122B2

(12) United States Patent
Bongio et al.

(10) Patent No.: US 8,787,122 B2
(45) Date of Patent: Jul. 22, 2014

(54) TIME REPORTING THROUGH VIBRATION

(75) Inventors: Jeremy Paul Bongio, Poughkeepsie, NY (US); Christopher J. Buccella, Poughkeepsie, NY (US); Michael Steven Chase-Salerno, New Paltz, NY (US); Sean Michael Swehla, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 528 days.

(21) Appl. No.: 13/149,082

(22) Filed: May 31, 2011

(65) Prior Publication Data

US 2012/0307603 A1 Dec. 6, 2012

(51) Int. Cl.

| | |
|---|---|
| ***G04B 19/06*** | (2006.01) |
| ***G04G 13/00*** | (2006.01) |
| ***G04B 25/04*** | (2006.01) |
| ***G04G 13/02*** | (2006.01) |

(52) U.S. Cl.

CPC ..... *G04B 25/04* (2013.01); *G04G 13/021* (2013.01)

USPC ..... 368/230; 368/243

(58) Field of Classification Search

CPC ..... G04B 25/04; G04G 13/021

USPC ..... 368/62, 73, 223, 230, 243, 250

See application file for complete search history.

(56) References Cited

U.S. PATENT DOCUMENTS

| | | | | |
|---|---|---|---|---|
| 3,938,317 | A * | 2/1976 | Spano | 368/62 |
| 4,055,843 | A * | 10/1977 | Whitaker | 340/384.71 |
| 4,176,518 | A * | 12/1979 | Kawakami et al. | 368/71 |
| 4,185,283 | A * | 1/1980 | Clark | 345/204 |
| 4,312,057 | A * | 1/1982 | Kume | 368/63 |
| 4,472,065 | A * | 9/1984 | Goodman | 368/71 |
| 5,559,761 | A * | 9/1996 | Frenkel et al. | 368/69 |
| 6,307,813 | B1 * | 10/2001 | Leggio | 368/63 |
| 7,019,622 | B2 | 3/2006 | Orr et al. | |
| 7,248,840 | B2 | 7/2007 | Chien | |
| 8,111,589 | B2 * | 2/2012 | Vidal | 368/71 |
| 2006/0246874 | A1 | 11/2006 | Sullivan | |
| 2007/0269034 | A1 | 11/2007 | Schurgin | |
| 2009/0265299 | A1 | 10/2009 | Hadad et al. | |

OTHER PUBLICATIONS

Lange, Maurice. "Telephonic Time Indication." Journal: Revue Generale de l'Electricite, vol. 32, pp. 421-425. Oct. 1, 1932. Country of Publication: France. (English Abstract Only).

Sahami, Alireza et al. "Rich Tactile Output on Mobile Devices." European Conference on Ambient Intelligence, Nurnberg, Germany, Nov. 2008. LNCS, Springer Verlag.

Toyssy, Sampo. "Telling Time by Vibration." Master's Thesis. University of Tampere, Department of Computer Sciences, Interactive Technology. Nov. 2007.

"Vibe O'Clock—Android," Copyright AndroidZoom, date printed Mar. 22, 2012 <http://www.androidzoom.com/android_applications/tools/vibe-oclock_desm.html>.

* cited by examiner

*Primary Examiner* — Vit W Miska

(74) *Attorney, Agent, or Firm* — Lieberman & Brandsdorfer, LLC

(57) ABSTRACT

A tool for reporting a particular time using vibration is disclosed. The tool assigns a distinct vibration to separate hour regions and minute regions. The tool uses a short series of vibration pulses, one of which is the distinct vibration assigned to the hour region associated with the hour of the particular time, to indicate the hour. The tool produces the distinct vibration assigned to the minute region associated with the minute of the particular time, to indicate the minute to the nearest quarter hour. The total sequence of pulses consists of no more than five separate vibrations.

19 Claims, 5 Drawing Sheets

TIME REPORTING THROUGH VIBRATION

FIELD OF THE INVENTION

The present invention relates generally to a mobile device user interface, and more particularly to an interface for tactile communication of a particular time.

BACKGROUND OF THE INVENTION

Frequently, day-to-day activities are organized around specific times. The ability to tell the time at any given point in a day has become an important aspect to the lives of many. Most often, one can determine the time visually by looking at a clock, such as on a watch or, more recently, a cellular device (cell phone, mobile phone). Alternatively, time can be communicated through audio. In rare instances, time is communicated through touch.

Telling time through touch has obvious benefits for those with seeing and/or hearing impairments. It may also be useful to convey the time discreetly. Those that are seeing impaired must detect time through other senses, and auditory clocks can be disturbing to those around. In addition, telling time through touch may prove useful to those who have traded in their wrist watches for the clock of a cell phone. In some situations, telling time with a cell phone may be difficult or dangerous (i.e., trying to wrestle a phone out of a front pocket while driving), or disturbing to other people (i.e., turning on the back light of the phone while in a dark theater).

Vibration has been used to report the time. However, using vibration has thus far involved pulsing out the hour and pulsing out the minutes in complicated sets of vibrations. Past methods have been long, unwieldy, hard to remember, and/or difficult to interpret. Additionally, these methods attempt a degree of precision unnecessary for many people's needs.

SUMMARY

Aspects of the present invention disclose a method, system, and program product for reporting a particular time using vibration. Using a computing device, assign a distinct vibration to each of a plurality of hour regions, each of the hour regions being associated with a number of hours. Assign a distinct vibration to each of a plurality of minute regions, each of the minute regions being associated with a number of minutes. Produce an hour sequence composed of one or more vibrations, at least one of the one or more vibrations being the distinct vibration assigned to an hour region of the plurality of hour regions, where one of the number of hours associated with the hour region is the hour of the particular time. Produce the distinct vibration assigned to a minute region of the plurality of minute regions, where one of the number of minutes associated with the minute region is the minute of the particular time. The distinct vibration represents an approximation of the minute of the particular time. Ideally, the total sequence used to report this approximation of a particular time, is less than five separate and minimal vibration pulses.

DETAILED DESCRIPTION

In the following detailed description, numerous specific details are set forth in order to provide a thorough understanding of the invention. However, it will be understood by those of ordinary skill in the art that the present invention may be practiced without these specific details. In other instances, well-known methods, procedures, and components have not been described in detail so as not to obscure the present invention.

Unless specifically stated otherwise, as apparent from the following discussions, it is appreciated that, throughout the specification, discussions utilizing terms such as "processing," "computing," "calculating," "determining," or the like, refer to the action and/or processes of a computer, computing system, or similar electronic computing device that manipulates and/or transforms data represented as physical, such as electronic, quantities within the computing system's registers and/or memories into other data similarly represented as physical quantities within the computing system's memories, registers or other such information storage, transmission, or display devices.

Figure 1:
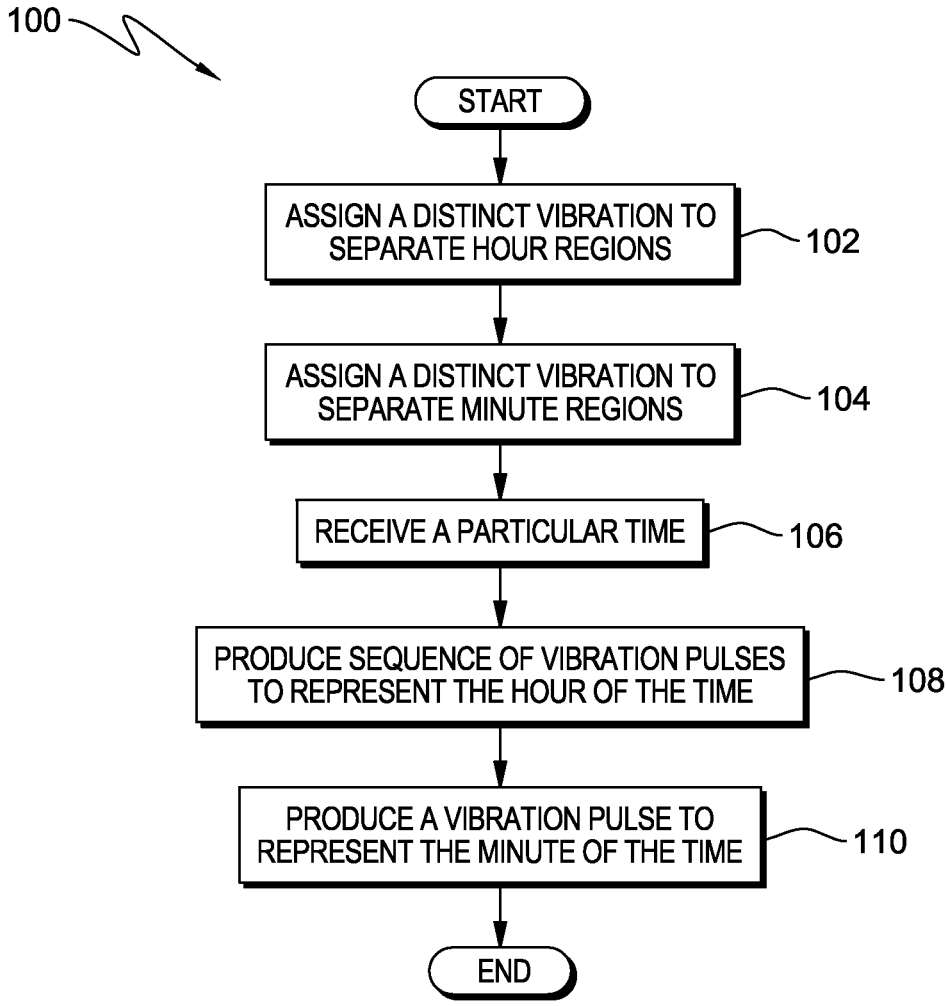
FIG. 1 depicts a flowchart of the steps of a program for reporting an approximate time through vibration in accordance with an illustrative embodiment.

FIG. 1 depicts a flowchart of the steps of time reporting program 100 for indicating an approximate time through vibration in accordance with an illustrative embodiment. Time reporting program 100 is a set of computer-readable instructions for approximating time through vibration using a computing device.

Time reporting program 100 assigns a distinct vibration to separate hour regions (step 102), where each hour region is associated with a number of potential hours.

In a preferred embodiment, the total number of potential hours is divided equally into the separate hour regions. The time is preferably based on a twelve hour clock, so one through twelve are the potential hours. In another embodiment, the time may be based on a twenty-four hour clock and the potential hours are one through twenty-four.

The number of hour regions must be less than the number of potential hours and more than one. In a preferred embodiment, there are four hour regions, each respective hour region containing three hours.

A distinct vibration consists of a unique identifier. For example, a distinct vibration may consist of a distinct frequency, with each distinct vibration having its own differentiable frequency. Distinct vibrations may also vary in length, consist of different patterns, or be made up of some combination of frequency, length, and/or pattern. Different patterns may include, for example, a flat pattern (motor on, motor off), sawtooth (linear increase of motor speed, stop, repeat), and sine wave (gradual increase, gradual decrease). For purposes of subsequent discussion, a distinct vibration may be referred to herein as a tone or vibration tone.

Four hour regions are preferred as four distinct vibration tones are easier to remember and to distinguish from one another than many distinct vibration tones.

Time reporting program 100 assigns a distinct vibration to separate minute regions (step 104), where each minute region is associated with a number of minutes.

Each separate minute region is preferably associated with an equal number of minutes. In a preferred embodiment, there are four separate minute regions, with each respective minute region associated with fifteen minutes. In the preferred embodiment, one of the four minute regions approximates a top of the hour (xx:00) and contains potential minute selections fifty-three through seven. A second of the four minute regions approximates quarter past the hour (xx:15) and contains potential minute selections eight through twenty-two. A third of the four minute regions approximates half past the hour (xx:30) and contains potential minute selections twenty-three through thirty-seven. A fourth of the four minute regions approximates forty-five minutes past the hour (xx:45) and contains potential minute selections thirty-eight through fifty-two.

In one embodiment, the number of minute regions equals the number of hour regions (preferably four), and the same distinct vibrations are used for each. In such an embodiment, it is preferred that distinct vibrations match for respective consecutive regions of hours and minutes (i.e., the distinct vibration for the first hour region matches the distinct vibration for the first minute region).

Time reporting program 100 receives a particular time (step 106). In a preferred embodiment, time reporting program 100 receives the time from an internal clock. In another embodiment, time reporting program 100 receives the time through a network. In one embodiment, time reporting program 100 parses the time into an hour and a minute. In another embodiment, time reporting program 100 receives the hour and receives the minute.

Time reporting program 100 can be triggered to receive the particular time (and subsequently report the particular time) by various means. In one embodiment, the trigger is a user request for the time. The request may be received via a button on the electronic device that may be pressed by a user. Alternatively, an interface screen may respond to pressure (such as a tap from a user). In other embodiments, time reporting program 100 may receive the particular time at predetermined intervals, set as a default or entered by a user. In such an embodiment, different vibration "alarms" may be set to go off throughout the day.

Based on the hour of the particular time, time reporting program 100 produces a sequence of vibration pulses to represent the hour of the particular time (step 108). A "pulse" refers to a vibration lasting for a length of time. This sequence may be referred to as the hour sequence. The hour sequence comprises one or more vibration pulses. At least one of the vibration pulses produced in the hour sequence is the distinct vibration assigned to the hour region associated with the hour of the particular time. For example, if the first hour region is associated with hours twelve, one, and two, and the particular time is one thirty, one of the vibration pulses is the distinct vibration assigned to the first hour region to distinguish the first hour region from the other hour regions.

The number of vibration pulses in the hour sequence comprises, at most, the number of potential hour selections (twelve or twenty-four) divided by the number of hour regions, plus one (hours/regions+1). For example, if using the twelve hour clock and four equal regions, the hour of the particular time is represented by no more than 4 separate vibration pulses. For purposes of this calculation, a distinct vibration tone, made up of a vibration pattern, is considered a single vibration pulse.

In one embodiment, the hour sequence comprises the following:

Time reporting program 100 determines the hour region associated with the hour of the particular time. Time reporting program 100 produces the distinct vibration, assigned to the hour region, a number of times equal to the consecutive order of the associated hour within the hour region. For example, if the hour region contains hours three, four, and five, and the hour of the particular time is three, the distinct vibration assigned to this hour region is produced once to indicate the first hour of the hour region. If the hour of the particular time is four, the distinct vibration is produced twice. And if the hour of the particular time is five, the distinct vibration is produced three times.

In a second embodiment, the hour sequence comprises the following:

Time reporting program 100 determines the hour region associated with the hour of the particular time. Time reporting program 100 produces the distinct vibration assigned to the determined hour region. Following the distinct vibration indicative of the hour region, time reporting program 100 produces one or more short vibration pulses (shorter than the distinct vibration) indicative of the consecutive order of the associated hour within the hour region. Using for example, again, an hour region containing hours three, four, and five, the distinct vibration assigned to this region is produced. Following the distinct vibration, a short pulse is produced once if the hour of the particular time is three, twice if the hour of the time is four, and three times if the hour of the time is five.

In a third (and the preferred) embodiment, the hour sequence comprises the following:

Time reporting program 100 determines the hour region associated with the hour of the particular time and produces the distinct vibration assigned to that region. Producing the distinct vibration by itself, in this embodiment, is indicative both of the hour region and of the first hour in that region. The production of a short vibration pulse after the distinct vibration is indicative of the second hour of the region, two short vibration pulses is indicative of the third hour of the region, and so on for all hours within the region. This is the shortest embodiment for the hour sequence and allows the shortest possible vibration lengths. Using this sequence, with the preferred four hour regions, the hour is indicated with no more than three separate vibration pulses (one distinct vibration and at most two short pulses to represent the third hour of the region).

Time reporting program 100 produces a single vibration pulse to indicate an approximation of the minute of the particular time (step 110) in a preferred embodiment. The vibration pulse produced is the distinct vibration assigned to the minute region associated with the minute of the particular time. For example, where a minute region is associated with potential minutes eight through twenty-two, and the minute of the particular time is eleven, time reporting program 100 produces the distinct vibration assigned to this minute region to give a user an approximate indication of a quarter past (fifteen minutes) the hour.

In an alternate embodiment, a sequence of vibration pulses may be used to indicate a closer estimate of the minute of the particular time. In such an embodiment, the first vibration pulse is the distinct vibration assigned to the minute region associated with the minute of the particular time. Subsequent short vibration pulses may be used to further narrow down the minute by indicating smaller sub-sections of the minute region. For example, where a minute region is composed of fifteen minutes, each subsequent vibration pulse could indicate a five minute span. To report eleven minutes past the hour, the distinct vibration pulse assigned to the top of the hour would be produced, followed by two short vibration pulses, to indicate an approximation of ten minutes past the top of the hour.

In a preferred embodiment, the particular time (hours and minutes) are approximated and indicated using no more than five separate vibration pulses.

Figure 2:
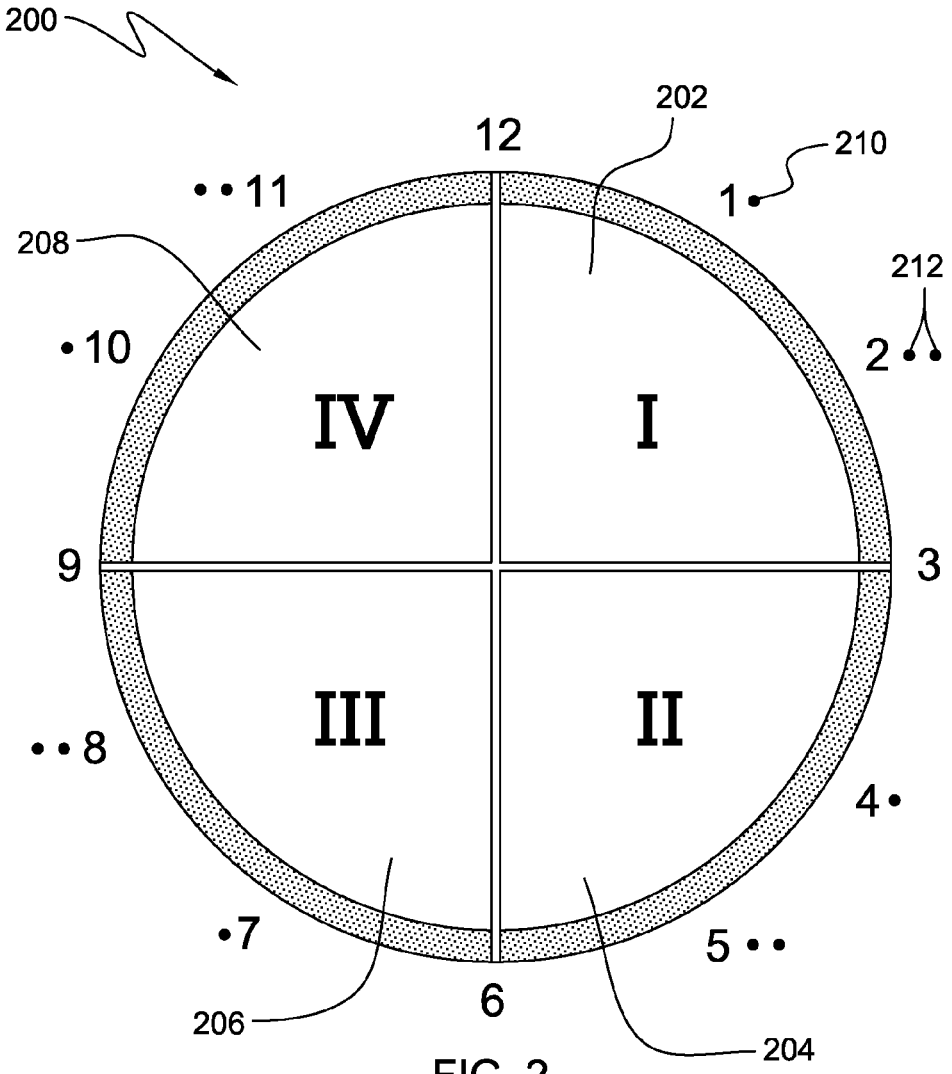
FIG. 2 illustrates a division of hours on a twelve hour clock in accordance with an embodiment of the invention.

FIG. 2 illustrates a division of hours on a twelve hour clock in accordance with an embodiment of the invention.

Clock 200 is representative of the twelve hour cycle of the preferred embodiment and contains potential hours one through twelve. In this embodiment, the potential hours are divided into four regions—region 202, region 204, region 206, and region 208.

In the depicted embodiment, region 202 is associated with hours twelve, one, and two; region 204 is associated with hours three, four, and five; region 206 is associated with hours six, seven, and eight; and region 208 is associated with hours nine, ten, and eleven. In another embodiment, regions 202, 204, 206, and 208 may be associated with hours one through three, four through six, seven through nine, and ten through twelve, respectively. Regions 202, 204, 206, and 208 are assigned distinct vibrations tones I, II, III, and IV, respectively. Other embodiments may include a different number of regions and different groupings of hours.

Single "bullet" 210 represents the second hour within a region ("bullet" merely refers to one of the round markings near a number representative of an hour). In a preferred embodiment, single bullet 210 is represented through vibration by a quick, short vibration pulse. Double bullet 212 represents the third hour within a region, and may be represented through vibration by two short vibration pulses.

As examples, using the embodiment in FIG. 2, the hour four is represented (in vibration) by producing tone II followed by a short pulse. The hour nine is represented by tone IV. The hour eight is represented by producing tone III, short pulse, short pulse.

Figure 3:
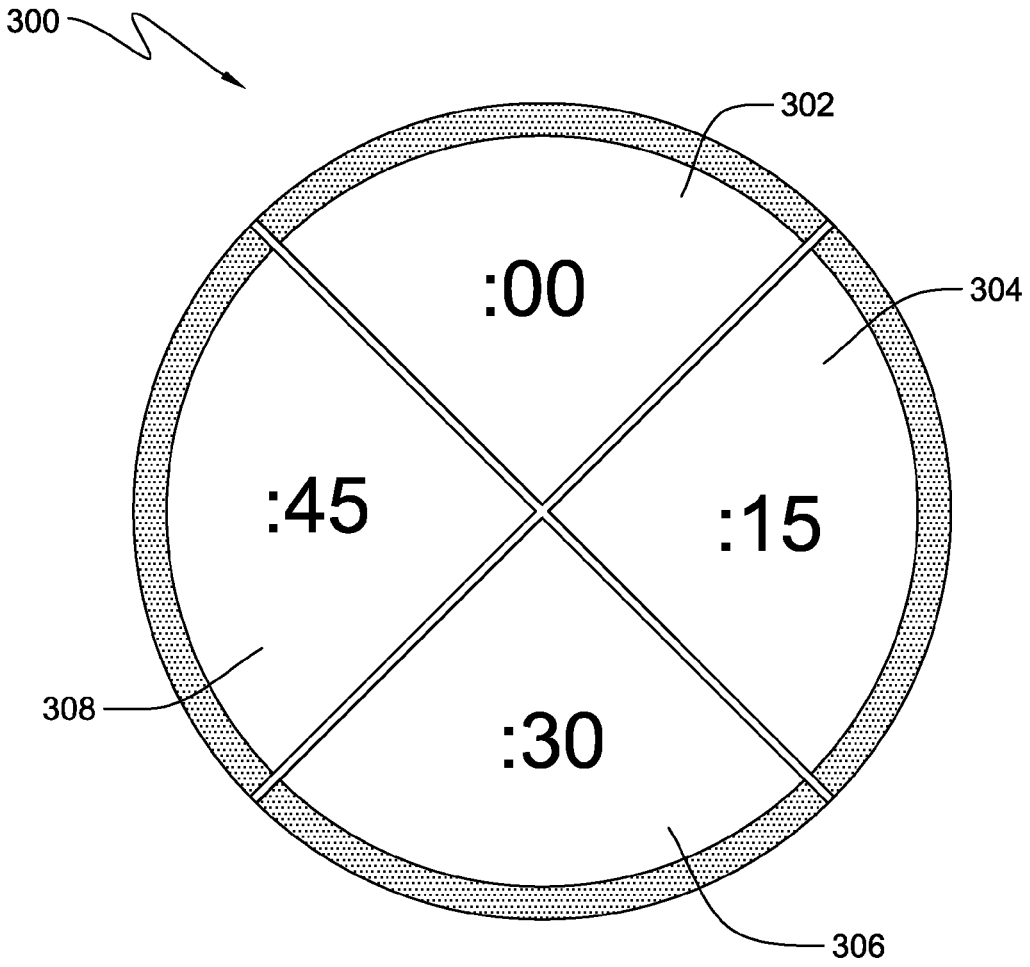
FIG. 3 depicts a division of minutes in accordance with an embodiment of the invention.

FIG. 3 depicts a division of minutes in accordance with an embodiment of the invention. Clock 300 is representative of the sixty minute cycle within an hour. The minutes of clock 300 are divided into four regions. Region 302 represents the top of the hour and is associated with the fifteen nearest minutes. Region 304 represents quarter past the hour (fifteen past) and is associated with the fifteen nearest minutes. Region 306 represents half past the hour (thirty minutes past) and is associated with the fifteen nearest minutes. Finally region 308 represents forty-five minutes past the hour and is associated with the fifteen nearest minutes. Other groupings may be used in other embodiments. Each of respective regions 302, 304, 306, and 308 is assigned a distinct vibration tone indicative of the nearest fifteen minute interval.

Figure 4:
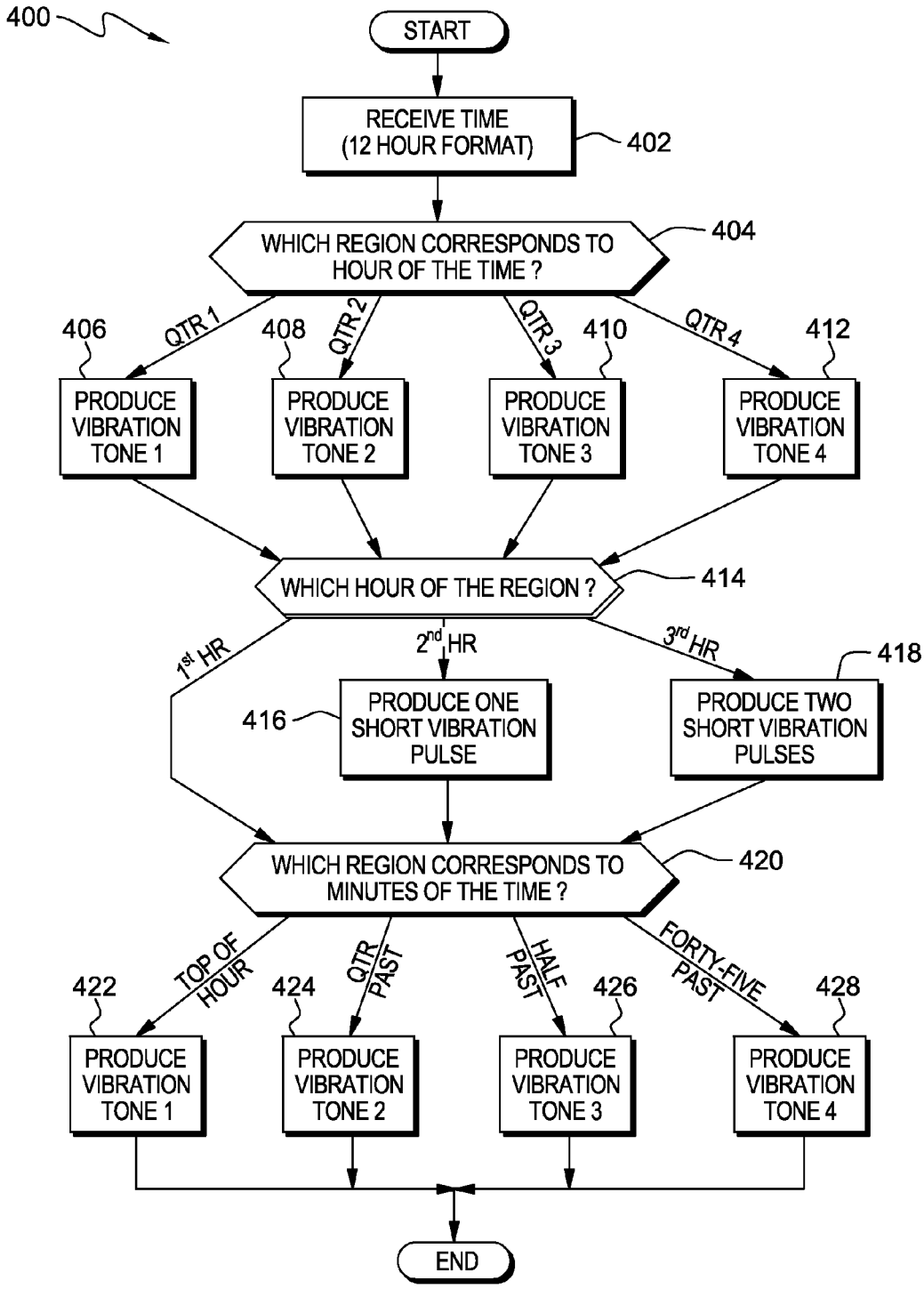
FIG. 4 illustrates a flowchart of the steps of a preferred embodiment of the program of FIG. 1.

FIG. 4 illustrates a flowchart of steps of time reporting program 400, which is a preferred embodiment of time reporting program 100. The preferred embodiment bases the time on the twelve hour clock, has four regions (or four quarters), each region associated with three potential hours and a distinct vibration. The preferred embodiment also has four regions of potential minutes, with each region associated with a fifteen minute interval and a distinct vibration.

The description of time reporting program 400 begins with the step of receiving the particular time (step 402). In one embodiment, time reporting program 400 receives the time in the twelve hour format. In another embodiment, time reporting program 400 receives the time in the twenty-four hour format and converts the time to the twelve hour format by subtracting twelve hours from the hour of the time when the hour of the particular time is greater than twelve. (If hr>12, hr=hr−12).

Time reporting program 400 determines which region corresponds to the hour of the particular time (decision block 404). If it is determined that the hour of the particular time corresponds to the first quarter (i.e., region associated with hours 12, 1, and 2), time reporting program 400 produces a first vibration tone (step 406). If it is determined that the hour of the time corresponds to the second quarter, time reporting program 400 produces a second vibration tone (step 408). If it is determined that the hour of the time corresponds to the third quarter, time reporting program 400 produces a third vibration tone (step 410). If it is determined that the hour of the time corresponds to the fourth quarter, time reporting program 400 produces a fourth vibration tone (step 412).

Time reporting program 400 also determines the consecutive order of the hour associated with the hour region (decision block 414). If the hour of the particular time corresponds to the first hour of the quarter, time reporting program 400 proceeds to decision block 420. If the hour of the particular time corresponds to the second hour of the quarter, time reporting program 400 produces one short vibration pulse (step 416) and then proceeds to decision block 420. If the hour of the particular time corresponds to the third hour of the quarter, time reporting program 400 produces two short vibration pulses (step 418) and then to decision block 420.

In decision block 420, time reporting program 400 determines which minute region corresponds to the minute of the time. Each region is an approximate of the nearest fifteen minute interval (i.e., :00, :15, :30, :45).

If the minute of the time corresponds to the region representative of the top of the hour (:00), time reporting program 400 produces the first vibration tone (step 422). In a preferred embodiment this is the same distinct vibration indicative of the first quarter hour region. If the minute of the particular time corresponds to the region representative of quarter past the hour (:15), time reporting program 400 produces the second vibration tone (step 424). If the minute of the particular time corresponds to the region representative of half past the hour (:30), time reporting program 400 produces the third vibration tone (step 426). If the minute of the particular time corresponds to the region representative of forty-five minutes past the hour (:45), time reporting program produces the fourth vibration tone (step 428).

In this manner, an approximation of the time—to the nearest fifteen minutes—is given through a short sequence of vibration pulses.

Figure 5:
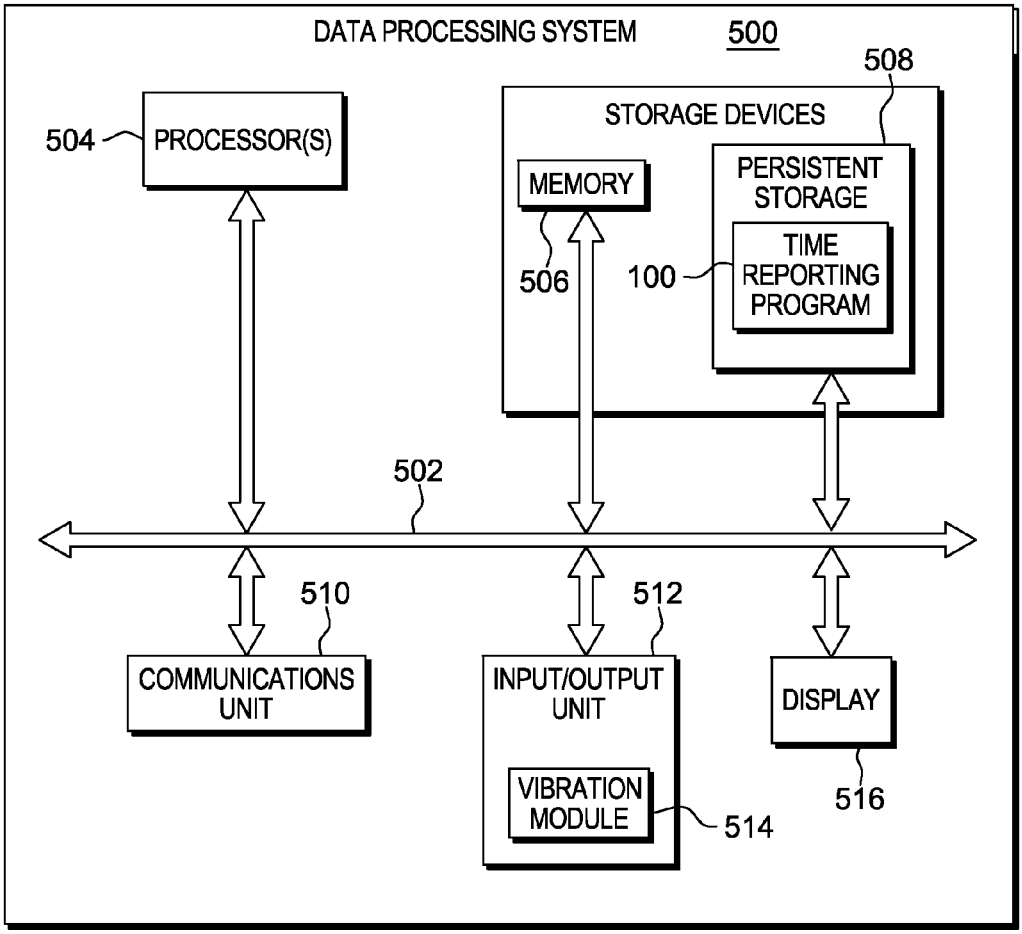
FIG. 5 depicts a block diagram of components of a data processing system in accordance with an illustrative embodiment.

FIG. 5 depicts a block diagram of components of a data processing system depicted in accordance with an illustrative embodiment. It should be appreciated that FIG. 5 provides only an illustration of one implementation and does not imply any limitations with regard to the environments in which different embodiments may be implemented. Many modifications to the depicted environments may be made.

Data processing system 500 is representative of any electronic device capable of executing machine-readable program instructions and producing vibration. In a preferred embodiment, data processing system is smart phone. Other embodiments include an electronic watch, a computer system, PDA, or laptop.

Data processing system 500 includes communications fabric 502 (such as a bus), which provides communications between processor(s) 504, memory 506, persistent storage 508, communications unit 510, input/output (I/O) unit 512, and display 516.

Memory 506 and persistent storage 508 are examples of computer-readable tangible storage devices. A storage device is any piece of hardware that is capable of storing information, such as, data, program code in functional form, and/or other suitable information on a temporary basis and/or permanent basis. Memory 506 may be, for example, one or more random access memories (RAM) or any other suitable volatile or non-volatile storage device.

Time reporting program 100 is stored in persistent memory 508 for execution by one or more of the respective processors 504 via one or more storage devices of memory 506 (which typically includes cache memory). In the embodiment illustrated in FIG. 5, persistent memory 508 includes flash memory. Alternatively, or in addition to, persistent memory 508 may include a magnetic disk storage device of an internal hard drive, a solid state drive, a semiconductor storage device, read-only memory (ROM), EPROM, or any other computer-readable tangible storage device that is capable of storing program instructions or digital information.

The media used by persistent storage 508 may also be removable. For example, a removable hard drive may be used for persistent storage 508. Other examples include an optical or magnetic disk that is inserted into a drive for transfer onto another storage device that is also a part of persistent storage 508, or other removable storage devices such as a thumb drive or smart card.

Communications unit 510, in these examples, provides for communications with other data processing systems or devices. In these examples, communications unit 510 includes a radio transmitter and a radio receiver. In another embodiment, communications unit 510 is network interface card. Communications unit 510 may provide communications through the use of either or both physical and wireless communications links. In another embodiment still, data processing system 500 may be devoid of communications unit 510.

Input/output unit 512 allows for input and output of data with other devices that may be connected to data processing system 500. For example, input/output unit 512 may provide a connection for user input through a keyboard, keypad, a microphone, and/or some other suitable input device. Further, input/output unit 512 may send output to a speaker or vibration module 514.

Vibration module 514 creates various vibration tones and pulses responsive to program instructions. The underlying mechanics of vibration module 514 include an unbalanced weight being spun around by an electric motor. The speed of the motor determines the frequency and tone created by vibration module 514. In another embodiment, vibration module 514 may include multiple motors.

Display 516 provides a mechanism to display information to a user. In a preferred embodiment, display 516 is the screen of a cell phone.

Time reporting program 100 can be written in various programming languages (such as Java or C++) including low-level, high-level, object-oriented or non object-oriented languages. Alternatively, the functions of time reporting program 100 can be implemented in whole or in part by computer circuits and other hardware (not shown).

Based on the foregoing, a computer system, method, and program product have been disclosed for reporting an approximate time through vibration. However, numerous modifications and substitutions can be made without deviating from the scope of the present invention. In this regard, each block in the flowcharts or block diagrams may represent a module, segment, or portion of code, which comprises one or more executable instructions for implementing the specified logical functions(s). It should also be noted that, in some alternative implementations, the functions noted in the flowcharts and block diagrams may occur out of the order noted in the figures. Therefore, the present invention has been disclosed by way of example and not limitation.

What is claimed is:

1. A method for reporting a particular time, composed of an hour and a minute, using vibration, the method comprising:

a computer assigning a distinct vibration to each of a plurality of hour regions, each of the hour regions being associated with a number of hours;

the computer assigning a distinct vibration to each of a plurality of minute regions, each of the minute regions being associated with a number of minutes;

the computer producing an hour sequence composed of one or more vibrations, at least one of the one or more vibrations being the distinct vibration assigned to an hour region of the plurality of hour regions, where one of the number of hours associated with the hour region is the hour of the particular time;

in response to the hour of the particular time being a first hour of the three hours associated with the hour region, the computer producing zero short vibrations;

in response to the hour of the particular time being a second hour of the three hours associated with the hour region, the computer producing one short vibration;

in response to the hour of the particular time being a third hour of the three hours associated with the hour region, the computer producing two short vibrations; and the computer producing a minute sequence composed of one or more vibrations, at least one of the one or more vibrations being the distinct vibration assigned to a minute region of the plurality of minute regions, where one of the number of minutes associated with the minute region is the minute of the particular time, and where the minute sequence represents an approximation of the minute of the particular time.

2. The method of claim 1, wherein the plurality of hour regions contains four hour regions, with each respective hour region associated with three hours.

3. The method of claim 1, wherein producing the hour sequence comprises:

the computer producing the distinct vibration assigned to the hour region and producing a number of separate vibrations, where the total number of vibrations, including the distinct vibration and the number of separate vibrations, is indicative of the respective hour of the number of hours associated with the hour region.

4. The method of claim 3, wherein each of the separate vibrations is either the distinct vibration or a vibration pulse shorter than the distinct vibration.

5. The method of claim 1, wherein producing the hour sequence comprises:

the computer producing the distinct vibration assigned to the hour region once to indicate the hour region; and the computer producing a number of separate vibrations indicative of the respective hour of the number of hours associated with the hour region.

6. The method of claim 1, wherein the plurality of minute regions contains four minute regions, with each respective minute region associated with fifteen minutes, and wherein the minute sequence comprises only the distinct vibration assigned to the minute region to indicate the minute of the particular time approximated to a fifteen minute interval.

7. The method of claim 6, wherein one of the four minute regions approximates a top of the hour and contains minutes fifty-three through seven, out of sixty minutes; a second of the four minute regions approximates quarter past the hour and contains minutes eight through twenty-two; a third of the four minute regions approximates half past the hour and contains minutes twenty-three through thirty-seven; and a fourth of the four minute regions approximates forty-five minutes past the hour and contains minutes thirty-eight through fifty-two.

8. The method of claim 1, wherein the particular time is approximated using at most five separate vibrations.

9. A computer system comprising one or more processors, one or more vibration modules, one or more computer-readable memories, one or more computer-readable, tangible storage devices, and program instructions which are stored on the one or more storage devices for execution by the one or more processors via the one or more memories and when executed by the one or more processors perform the method of claim 1.

10. A computer program product for reporting a particular time, composed of an hour and a minute, using vibration, the computer program product comprising:

one or more computer-readable tangible storage devices and program instructions stored on at least one of the one or more storage devices, the program instructions comprising:

program instructions to assign a distinct vibration to each of a plurality of hour regions, each of the hour regions being associated with a number of hours;

program instructions to assign a distinct vibration to each of a plurality of minute regions, each of the minute regions being associated with a number of minutes;

program instructions to produce an hour sequence composed of one or more vibrations, at least one of the one or more vibrations being the distinct vibration assigned to an hour region of the plurality of hour regions, where one of the number of hours associated with the hour region is the hour of the particular time;

in response to the hour of the particular time being a first hour of the three hours associated with the hour region, the computer producing zero short vibrations;

in response to the hour of the particular time being a second hour of the three hours associated with the hour region, the computer producing one short vibration;

in response to the hour of the particular time being a third hour of the three hours associated with the hour region, the computer producing two short vibrations; and program instructions to produce a minute sequence composed of one or more vibrations, at least one of the one or more vibrations being the distinct vibration assigned to a minute region of the plurality of minute regions, where one of the number of minutes associated with the minute region is the minute of the particular time, and where the minute sequence represents an approximation of the minute of the particular time.

11. The computer program product of claim 10, wherein the plurality of hour regions contains four hour regions, with each respective hour region associated with three hours.

12. The computer program product of claim 10, wherein the program instructions to produce the hour sequence:

produce the distinct vibration assigned to the hour region once to indicate that the hour of the particular time is a first hour of the number of hours associated with the hour region.

13. The computer program product of claim 10, wherein the program instructions to produce the hour sequence:

produce the distinct vibration assigned to the hour region and producing a number of separate vibrations, where the total number of vibrations, including the distinct vibration and the number of separate vibrations, is indicative of the respective hour of the number of hours associated with the hour region.

14. The computer program product of claim 13, wherein each of the separate vibrations is either the distinct vibration or a vibration pulse shorter than the distinct vibration.

15. The computer program product of claim 11, wherein the program instructions to produce the hour sequence:

produce the distinct vibration assigned to the hour region once to indicate the hour region; and produce a number of separate vibrations indicative of the respective hour of the number of hours associated with the hour region.

16. The computer program product of claim 10, wherein the plurality of minute regions contains four minute regions, with each respective minute region associated with fifteen minutes, and wherein the minute sequence comprises only the distinct vibration assigned to the minute region to indicate the minute of the particular time approximated to a fifteen minute interval.

17. The computer program product of claim 16, wherein one of the four minute regions approximates a top of the hour and contains minutes fifty-three through seven, out of sixty minutes; a second of the four minute regions approximates quarter past the hour and contains minutes eight through twenty-two; a third of the four minute regions approximates half past the hour and contains minutes twenty-three through thirty-seven; and a fourth of the four minute regions approximates forty-five minutes past the hour and contains minutes thirty-eight through fifty-two.

18. The computer program product of claim 10, wherein the particular time is approximated using at most five separate vibrations.

19. A method for reporting a particular time, composed of an hour and a minute, using vibration, the method comprising:

a computer assigning a distinct vibration to each of four hour regions, where each hour region is associated with three hours;

the computer assigning a distinct vibration to each of four minute regions, where each minute region is associated with fifteen minutes;

the computer producing the distinct vibration assigned to the hour region associated with the hour of the particular time;

in response to the hour of the particular time being a first hour of the three hours associated with the hour region, the computer producing zero short vibrations;

in response to the hour of the particular time being a second hour of the three hours associated with the hour region, the computer producing one short vibration;

in response to the hour of the particular time being a third hour of the three hours associated with the hour region, the computer producing two short vibrations; and the computer producing the distinct vibration assigned to the minute region associated with the minute of the particular time, where the distinct vibration assigned to the minute region represents an approximation of the minute of the particular time.

* * * * *